United States Patent [19]

Piggin et al.

[11] Patent Number: 5,061,609

[45] Date of Patent: Oct. 29, 1991

[54] PROCESS OF PREPARING A TABULAR GRAIN SILVER BROMOIODIDE EMULSION AND EMULSIONS PRODUCED THEREBY

[75] Inventors: Roger H. Piggin, Abbots Langley; Colin J. Bishop, Hatch End, both of United Kingdom

[73] Assignee: Eastman Kodak Company, Rochester, N.Y.

[21] Appl. No.: 417,144

[22] Filed: Oct. 4, 1989

[30] Foreign Application Priority Data

Jul. 13, 1989 [GB] United Kingdom ..... 8916041

[51] Int. Cl.[5] ..... G03C 1/015

[52] U.S. Cl. ..... 430/569; 430/567

[58] Field of Search ..... 430/569, 567

[56] References Cited

U.S. PATENT DOCUMENTS

| | | | |
|---|---|---|---|
| 4,414,304 | 11/1983 | Dickerson | 430/353 |
| 4,414,310 | 11/1983 | Daubendiek | 430/567 |
| 4,425,425 | 1/1984 | Abbott et al. | 430/502 |
| 4,425,426 | 1/1984 | Abbott et al. | 430/502 |
| 4,433,048 | 2/1984 | Solberg et al. | 430/434 |
| 4,434,226 | 2/1984 | Wilgus et al. | 430/567 |
| 4,439,520 | 3/1984 | Kofron | 430/434 |
| 4,478,929 | 10/1984 | Jones et al. | 430/217 |
| 4,614,711 | 9/1986 | Sugimoto et al. | 430/567 |
| 4,665,012 | 5/1987 | Sugimoto et al. | 430/502 |
| 4,672,027 | 5/1987 | Daubendiek et al. | 430/505 |
| 4,693,964 | 9/1987 | Daubendiek et al. | 430/505 |
| 4,713,320 | 12/1987 | Maskasky | 430/567 |
| 4,806,461 | 2/1989 | Ikeda et al. | 430/567 |

FOREIGN PATENT DOCUMENTS

| | | |
|---|---|---|
| 131247 | 6/1987 | Japan . |
| 106746 | 5/1988 | Japan . |

*Primary Examiner*—Charles L. Bowers, Jr.
*Assistant Examiner*—Janet C. Baxter
*Attorney, Agent, or Firm*—Carl O. Thomas

[57] ABSTRACT

A process is disclosed for the preparation of a tabular grain silver bromoiodide emulsion in which silver bromoiodide laminae are formed on the major faces of the tabular grains. The sensitivity of the emulsion as a function of pressure applied is rendered more nearly constant by forming the silver bromoiodide laminae on the major faces of the tabular grains. The silver bromoiodide laminae are formed on the major faces of the tabular grains with an iodide content higher than that of the host emulsion, and thereafter, within the pAg and temperature boundaries defined by Curve A in FIG. 1, bromide is deposited as a silver salt with the addition of iodide being limited or absent.

16 Claims, 1 Drawing Sheet

PROCESS OF PREPARING A TABULAR GRAIN SILVER BROMOIODIDE EMULSION AND EMULSIONS PRODUCED THEREBY

FIELD OF THE INVENTION

The invention relates to a process of preparing camera speed photographic emulsions and to the emulsions so produced. More specifically, the invention relates to a process for the preparation of tabular grain silver bromoiodide emulsions and to the emulsions produced thereby.

BACKGROUND OF THE INVENTION

The highest speed photographic emulsions are recognized to be silver bromoiodide emulsions. Because of their larger size, the presence of iodide ions in the silver bromide crystal structure of the grains is recognized to produce lattice irregularities that enhance latent image formation (observed as increased imaging sensitivity) on exposure to electromagnetic radiation.

Silver halide photography has benefitted in this decade from the development of tabular grain silver bromoiodide emulsions. As employed herein the term "tabular grain emulsion" designates any emulsion in which at least 50 percent of the total grain projected area is accounted for by tabular grains. Whereas tabular grains have long been recognized to exist to some degree in conventional emulsions, only recently has the photographically advantageous role of the tabular grain shape been appreciated.

Tabular grain silver bromoiodide emulsions exhibiting particularly advantageous photographic properties include (i) high aspect ratio tabular grain silver halide emulsions and (ii) thin, intermediate aspect ratio tabular grain silver halide emulsions. High aspect ratio tabular grain emulsions are those in which the tabular grains exhibit an average aspect ratio of greater than 8:1. Thin, intermediate aspect ratio tabular grain emulsions are those in which the tabular grain emulsions of a thickness of less than 0.2 μm have an average aspect ratio in the range of from 5:1 to 8:1.

The common feature of high aspect ratio and thin, intermediate aspect ratio tabular grain emulsions, hereinafter collectively referred to as "recent tabular grain emulsions", is that tabular grain thickness is reduced in relation to the equivalent circular diameter of the tabular grains. Most of the recent tabular grain emulsions can be differentiated from those known in the art for many years by the following relationship:

$$ECD/t^2 > 25 \quad (1)$$

where

ECD is the average equivalent circular diameter in μm of the tabular grains and t is the average thickness in μm of the tabular grains. The term "equivalent circular diameter" is employed in its art recognized sense to indicate the diameter of a circle having an area equal to that of the projected area of a grain, in this instance a tabular grain. All tabular grain averages referred to are to be understood to be number averages, except as otherwise indicated.

Since the average aspect ratio of a tabular grain emulsion satisfies relationship (2):

$$AR = ECD/t \quad (2)$$

where

AR is the average tabular grain aspect ratio and

ECD and t are as previously defined, it is apparent that relationship (1) can be alternatively written as relationship (3):

$$AR/t > 25 \quad (3)$$

Relationship (3) makes plain the importance of both average aspect ratios and average thicknesses of tabular grains in arriving at preferred tabular grain emulsions having the most desirable photographic properties.

The following illustrate recent tabular grain silver bromoiodide emulsions satisfying relationships (1) and (3):

R-1: U.S. Pat. No. 4,414,304, Dickerson;
R-2: U.S. Pat. No. 4,414,310, Daubendiek et al;
R-3: U.S. Pat. No. 4,425,425, Abbott et al;
R-4: U.S. Pat. No. 4,425,426, Abbott et al;
R-5: U.S. Pat. No. 4,434,226, Wilgus et al;
R-6: U.S. Pat. No. 4,439,520, Kofron et al;
R-7: U.S. Pat. No. 4,478,929, Jones et al;
R-8: U.S. Pat. No. 4,672,027, Daubendiek et al,
R-9: U.S. Pat. No. 4,693,964, Daubendiek et al;
R-10: U.S. Pat. No. 4,713,320, Maskasky; and
R-11: *Research Disclosure*, Vol. 299, Mar. 10, 1989, Item 29945.

*Research Disclosure* is published by Kenneth Mason Publications, Ltd., Dudley Annex, 21a North Street, Emsworth, Hampshire P010 7DQ, England.

The recent tabular grain emulsions have been observed to provide a large variety of photographic advantages, including, but not limited to, improved speed-granularity relationships, increased image sharpness, a capability for more rapid processing, increased covering power, reduced covering power loss at higher levels of forehardening, higher gamma for a given level of grain size dispersity, less image variance as a function of processing time and/or temperature variances, higher separations of blue and minus blue speeds, the capability of optimizing light transmission or reflectance as a function of grain thickness, and reduced susceptibility to background radiation damage in very high speed emulsions.

It has been recognized that still further improvements in emulsion sensitivity without any increase in granularity can be realized by forming recent tabular grain silver bromoiodide emulsions with iodide non uniformly distributed within the grains. This is illustrated by the following patent:

R-12: U.S. Pat. No. 4,433,048, Solberg Piggin et al.

Solberg Piggin et al, which contains teachings compatible with and in most instances forming a integral part of the teachings of R-1 to R-11 inclusive, discloses forming tabular grain emulsions with a lower proportion of iodide in a central region of the tabular grain structure than in a laterally offset region. When iodide concentrations are progressively increased as the grains are grown, the central region preferably forms a minor part of the tabular grain. On the other hand, with abrupt differences in iodide concentrations between the central and laterally displaced regions, the central region preferably forms the major portion of the tabular grain.

R-13: U.S. Pat. No. 4,806,461, Ikeda et al to the extent pertinent is considered essentially cumulative with Solberg Piggin et al.

Investigations of tabular grain silver bromoiodide emulsions prepared according to the teachings of Solberg Piggin et al prepared by abruptly increasing iodide to form laterally displaced regions of the tabular grains has revealed that at least a portion of the iodide redistributes itself over the major faces of the tabular grains. Thus, higher iodide silver bromoiodide surface laminae have been identified on the tabular grains of these emulsions.

While the recent tabular grain emulsions have advanced the state of the art in almost every grain related parameter of significance in silver halide photography, one area of concern has been the susceptibility of tabular grain emulsions to vary in their photographic response as a function of the application of localized pressure on the grains. As might be intuitively predicted from the high proportion of less compact grain geometrics in the recent tabular grain emulsions, pressure (e.g., kinking, bending, or localized stress) desensitization, a long standing concern in silver halide photography, is a continuing concern in photographic elements containing recent tabular grain silver bromoiodide emulsions.

It is suggested by

R-14: Japanese Kokai SHO 63[1988]-106746, Shibata et al that the pressure sensitivity of emulsions with average aspect ratios of greater than 2:1 can be reduced by forming silver halide laminae of differing halide content on the major faces of the grains. A tabular grain silver bromoiodide emulsion with higher iodide levels in the tabular grain laminae prepared under the closest pAg conditions to those of the present invention is EM 5. As demonstrated by the Examples below, EM 5, shown in FIG. 1 as point R-14, is clearly outside the range of preparation conditions yielding emulsions of improved constancy of sensitivity as a function of pressure applied. In most instances Shibata et al formed tabular grain laminae at much higher excesses of halide ion (higher pAg levels). As will become apparent from the description of preferred embodiments Shibata et al EM-5 exhibits other significant differences from the emulsions of this invention.

SUMMARY OF THE INVENTION

In one aspect this invention is directed to a process for the preparation of a silver bromoiodide emulsion comprising providing a host emulsion comprised of a dispersing medium and silver bromide grains optionally including iodide in which greater than 50 percent of the total grain projected area is accounted for by tabular grains satisfying the relationship $$ECD/t^2 > 25$$

where ECD is the mean effective circular diameter in μm of the tabular grains and t is the mean thickness in μm of the tabular grains and forming silver bromoiodide laminae on the major faces of the tabular grains.

The process is characterized in that sensitivity as a function of pressure applied to the silver bromoiodide emulsion is rendered more nearly constant by forming the silver bromoiodide laminae on the major faces of the tabular grains by the steps of (a) forming the silver bromoiodide laminae on the major faces of the tabular grains with an iodide content higher than that of the host emulsion and at least 5 mole percent, based on silver precipitated during this step, and (b) within the pAg and temperature boundaries defined by Curve A in FIG. 1 depositing bromide as a silver salt with any additional iodide supplied to the emulsion during this step being limited to less than 5 mole percent, based on silver introduced during this step.

In another aspect, the invention is directed to tabular grain silver bromoiodide emulsions prepared by the processes of this invention.

BRIEF DESCRIPTION OF THE DRAWINGS

The invention can be better appreciated by reference to the following detailed description considered in conjunction with the drawings, in which.

DESCRIPTION OF PREFERRED EMBODIMENTS

Figure 1:
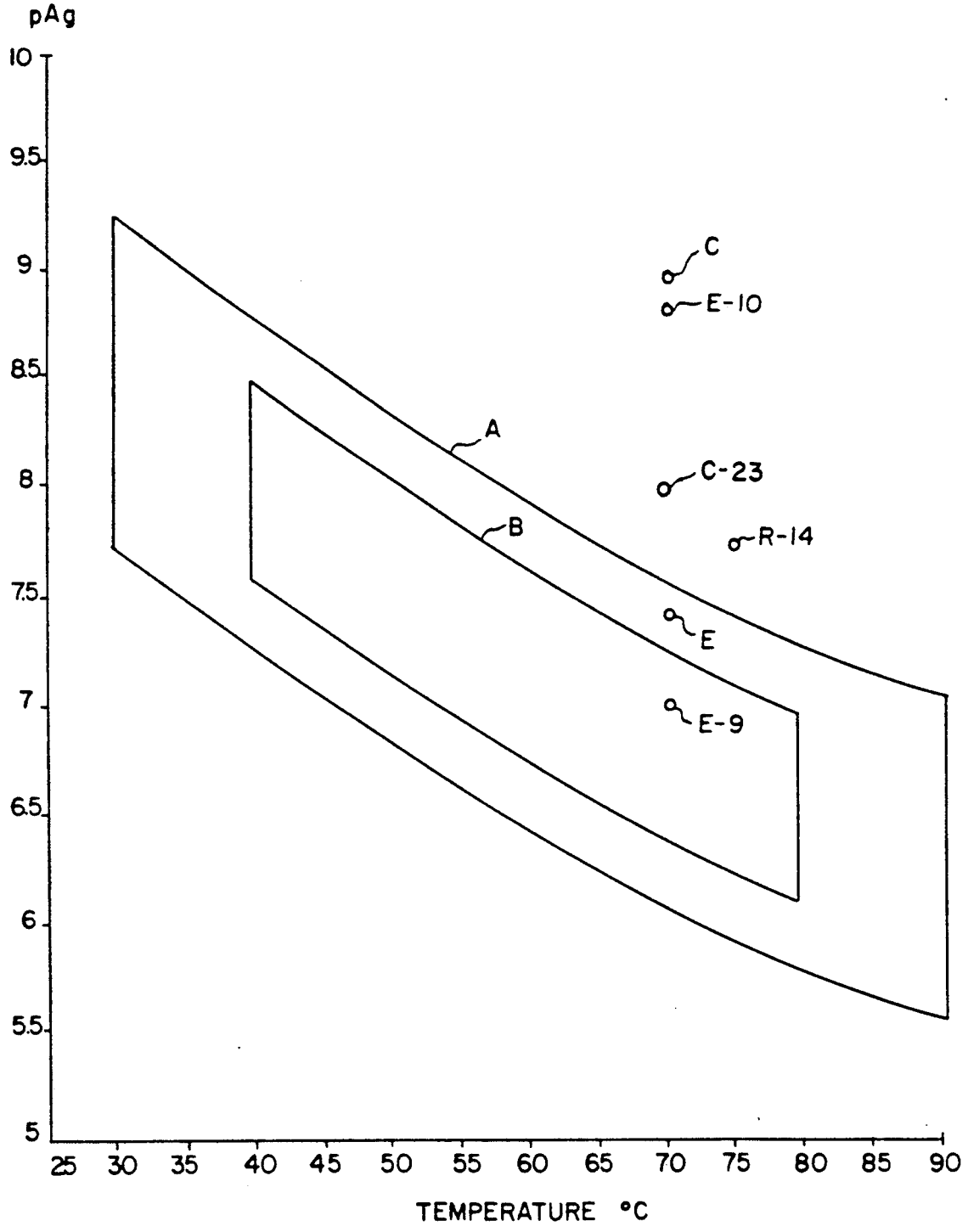
FIG. 1 is a plot of pAg versus temperature in degrees Celsius.

The present invention is based on the discovery that the radiation exposure sensitivity advantages of the recent tabular grain silver bromoiodide emulsion technology can be realized while at the same time achieving pressure stability levels that are more nearly constant than have been characteristic of recent tabular grain silver bromoiodide emulsions heretofore available to those skilled in the art. Alternatively stated, the present invention is based on the discovery of recent tabular grain emulsions and methods for their manufacture which are less susceptible to pressure desensitization. Pressure desensitization can arise from bending, kinking, spooling, dragging across out of adjustment transport rolls, any type of compressive force, and any other manipulation that applies pressure to the emulsion layer or layers of a photographic element. While pressure desensitization can occur over all or part of the photographic element, localized pressure desensitization is most objectionable, since it is highly visible as a local defect in the photographic image.

The present invention is predicated on the discovery of a selected set of conditions for forming silver bromoiodide laminae on the major surfaces of tabular grains. Specifically, achieving both high levels of sensitivity and resistance to pressure desensitization results from first depositing silver bromoiodide on the major faces of host tabular grains, the laminae being formed with a significantly higher iodide content than the host tabular grains, followed by precipitating bromide as a silver salt over the laminae under newly identified and selected conditions with iodide addition during precipitation of the bromide silver salt being limited.

At present there is no fully consistent and corroborated explanation of why the emulsions produced as described above exhibit both highly advantageous speed-granularity relationships and high levels of stability when subjected to pressure. The high levels of radiation sensitivity of the emulsions is believed to be the result of the non uniform placement of iodide within the tabular grains. Improved pressure stability is believed to result from recrystallization of iodide taking place during the step of precipitating the bromide silver salt. It is believed that at least a portion of the iodide introduced in the silver bromoiodide laminae is recrystallized during the subsequent bromide silver salt deposition. Thus, the bromide silver salt deposition is believed to contain some iodide, even when no additional iodide is added to the emulsion during its formation. Iodide recrystallization is undertaken under conditions more nearly approaching the equivalence point than have heretofore been employed in forming tabular grain silver bromoiodide laminae. The equivalence point is a 1:1 atomic ratio of silver ion to halide ion in solution. With rare exceptions photographic silver halide emulsions are precipitated on the halide side of the equivalence point (with an excess of halide ions as compared to silver ions). This is undertaken to avoid occlusions within the grains of excess silver ion, thereby guarding against elevated minimum densities (i.e.. fog). It has been recognized in investigating this invention that by precipitating the bromide silver salt nearer to the equivalence point the large solubility difference between silver bromide and silver iodide is narrowed. This suggests that bromide and iodide ions may form with silver a more orderly cubic crystal lattice than is otherwise possible and that the increased order of the crystal lattice is responsible for the more nearly constant sensitivity of the emulsions as a function of applied pressure. However, it must be borne in mind that silver bromoiodide emulsions rely on some degree of crystal lattice irregularities for their superior speed granularity relationships. Thus, it appears that the process of the invention has achieved an advantageous balance of crystal lattice order that was not predicted and cannot at present be precisely described.

While emulsion theory and grain analyses are suggestive, a clear and conclusive cause and effect relationship has been established between emulsion preparation steps and improved photographic performance. Accordingly, the emulsions of the invention are described in terms of the steps employed in their preparation, supplemented by analytical observations.

The first step in the preparation of an emulsion demonstrating the advantages of this invention is the preparation or selection for use as a host emulsion of a recent tabular grain emulsion containing a dispersing medium and silver bromide grains optionally containing iodide satisfying relationships (1) and (3) above. Any convenient conventional emulsion of this type can be prepared or selected. Preferred emulsions are illustrated by the teachings of R-1 to R-11, cited above and here incorporated by reference. As taught by R-6 (Kofron et al), the preparation of tabular grain silver bromoiodide emulsions can be readily adapted to forming tabular grain silver bromide emulsions merely by omitting iodide from the precipitation process. The sole exception to this is the precipitation process of R 2 (Daubendiek et al), which requires the use of silver iodide seed grains for tabular grain nucleation and is therefore limited to the preparation of silver bromoiodide emulsions.

The host tabular grain emulsion contains a lower concentration of iodide than the silver bromoiodide laminae to be deposited thereon. It is preferred that the host tabular grain emulsion contain less than 5 mole percent iodide and optimally less than 2 mole percent iodide. Silver bromide host tabular grain emulsions are specifically contemplated and preferred. An advantage of silver bromide host tabular grain emulsions is that they lend themselves to higher levels of tabularity over a wider range of preparation conditions than silver bromoiodide emulsions. More importantly, by initially excluding iodide from the host tabular grains, all of the product emulsion iodide is more readily available to be acted upon by the deposition steps of this process.

Since silver bromoiodide laminae are to be deposited onto the major faces of the tabular grains of the host emulsion, the tabular grains of the silver bromoiodide product emulsions exhibit somewhat greater thickness than the host tabular grains from which they are prepared. Where the silver bromoiodide laminae are of minimum thickness, the increased thickness of the silver bromoiodide product emulsion tabular grains is generally negligible.

Nevertheless, if it is intended that the product silver bromoiodide emulsion also satisfy relationships (1) and (3), as is preferred for the highest levels of performance, the ratio of tabular grain diameter to thickness of the host emulsion reflected in relationships (1) and (3) is increased somewhat above the minimum values indicated above. Preferably the tabular grain diameter to thickness ratio of relationships (1) and (3) is greater than 40 and optimally greater than 80. Preferred host tabular grain emulsions are those in which the mean tabular grain thickness is less than 0.2 μm. Since the benefits of the invention are provided by tabular grains, it is preferred that tabular grains account for at least 70 percent and optimally at least 90 percent of the total grain projected area of the host emulsion.

The tabular grain host emulsion is generally chosen to provide a mean tabular grain effective circular diameter at least 50 percent, preferably at least 90 percent, that of the silver bromoiodide product emulsion. It is possible to form the silver bromoiodide product emulsion without increasing the mean effective circular diameter of the product emulsion as compared to that of the host emulsion. The host emulsion can account for as little as 20 percent, based on silver, of the silver bromoiodide product emulsion. Host emulsions in which the tabular grains are relatively thin (e.g., less than 0.2 μm and preferably less than 0.1 μm) particularly lend themselves to forming product emulsions in which silver halide deposited on the host tabular grains accounts for most of the grain volume. By holding the later deposited silver halide to a minimum the host emulsion can account for up to 89 percent of the total silver forming the silver bromoiodide product emulsion. The host emulsion preferably accounts for from 40 percent to 70 percent of the total silver forming the silver bromoiodide product emulsion.

Any conventional approach for depositing silver bromoiodide laminae on the major faces of the tabular grains of the host emulsion can be employed in the practice of this invention. For example, R-5 and R-6 both teach that silver bromoiodide can be directed to the major faces of tabular grains by raising the pBr (the negative logarithm of bromide ion activity) above 2.2. When a low methionine peptizer is employed as taught by R-10, then the pBr should be higher than 2.4. A preferred technique for depositing silver bromoiodide on the major faces of the tabular grains of the host emulsion is to conduct precipitation of silver bromoiodide within the boundaries of Curve A (optimally within the boundaries of Curve B) in FIG. 1, as discussed more fully below in connection with later deposition of the bromide silver salt.

From 1 to 40 percent of the total silver forming the product silver bromoiodide emulsion is preferably introduced in forming the silver bromoiodide laminae. Optimally the silver bromoiodide laminae contain from 5 to 25 percent of the total silver of the product silver bromoiodide emulsion.

The primary function to be served by the silver bromoiodide laminae is provide a source of iodide for achieving the best possible speed-granularity relationship for the product emulsion. Therefore, the silver bromoiodide laminae as deposited on the host tabular grains contain at least 5 mole percent iodide, based on silver precipitated during formation of the laminae. Preferably the laminae as formed contain at least 10 mole percent iodide and optimally at least 15 mole percent iodide. The maximum incorporation of iodide in a silver bromide crystal lattice without phase separation is generally accepted as 40 mole percent. To avoid phase separation of silver iodide it is therefore preferred that the silver bromoiodide laminae be formed with an iodide content of up to 40 mole percent, optimally up to 35 mole percent, all percentages being based on silver introduced in forming the laminae.

Once a tabular grain host emulsion has been obtained with silver bromoiodide laminae deposited on major faces of the host tabular grains, the next step of the process is to run into the emulsion silver and bromide salts under selected conditions. As demonstrated by the Comparative Examples, presented below, realization of the advantages of the invention requires deposition onto the silver bromoiodide laminae within a selected pAg range.

It is believed that deposition onto the silver bromoiodide laminae recrystallizes or otherwise redistributes the iodide ions of the laminae in an manner not presently fully understood. It is believed that some of the iodide ions initially in the laminae migrate into the silver bromide crystal structure being deposited onto the laminae. Thus, it is believed that a bromide salt of silver which also includes iodide is deposited onto the silver bromoiodide laminae, although the iodide content of the later deposited bromide silver salt is lower than that of the laminae.

To provide an increased opportunity for iodide redistribution it is preferred to run bromide as the sole halide salt into the emulsion during deposition onto the silver bromoiodide laminae. However, it is recognized that the introduction of additional iodide during this step can be tolerated, but the iodide concentration must be kept below that in the silver bromoiodide laminae. Iodide preferably constitutes less than 5 mole percent of total halide introduced during precipitation onto the silver bromoiodide laminae. Optimally iodide introduced into the emulsion during this step is less than 1 mole percent of the total halide introduced.

Referring to FIG. 1, to be effective in achieving the advantages of the invention the pAg employed for deposition onto the silver bromoiodide laminae formation is that indicated by the higher and lower pAg boundaries indicated by Curve A, with the higher and lower pAg boundaries of Curve B defining preferred pAg ranges. Unlike the upper and lower pAg boundaries the temperature limits of 30° to 90° C. for Curve A and 40° to 80° C. for Curve B are not critical, but are selected to reflect the temperature ranges most commonly and conveniently employed in preparing photographic emulsions.

The variance of effective pAg limits as a function of temperature is directly related to the known variance of the solubility product constant of silver bromide ($K_{sp}$) with temperature. In a simple emulsion in which silver and halide ions are in equilibrium, the relationship between $K_{sp}$ and pAg can be expressed as follows:

$$-\log K_{sp} = pAg + pX \quad (4)$$

where $K_{sp}$ is the solubility product constant for the emulsion;

pAg is the negative logrithm of silver ion activity; and pX is the negative logrithm of halide ion activity. For silver bromide $-\log$ varies from 10.1° at 80° C. to 11.6° at 40° C., a difference of one and half orders of magnitude. For silver iodide $-\log K_{sp}$ varies from 13.2° at 80° C. to 15.2° at 40° C. Since the $-\log K_{sp}$ of silver bromide is about 3 orders of magnitude (1000 times) greater than that of silver iodide, it is apparent that it is the $-\log K_{sp}$ of silver bromide that controls pAg in a silver bromoiodide emulsion under equilibrium conditions. Other silver salt forming anions, if present, can have a greater or lesser influence, depending upon their relative solubilities.

As has been previously stated, one of the features of the present invention is that deposition onto the silver bromoiodide laminae occurs on the halide side of, but nearer, the equivalence point than prior art emulsions. The equivalence point of an emulsion of a silver halide emulsion satisfies the relationship:

$$pAg = pX = -\log K_{sp}/2 \quad (5)$$

Thus, the upper and lower boundaries of Curves A and B must be varied as a function of temperature to insure that they remain in a fixed relationship with the equivalence point of the emulsion at each temperature within the range. Once the upper and lower limits of the pAg boundaries have been established at a selected temperature, it is apparent that temperature adjustments of pAg limits can be achieved from known temperature versus $-\log K_{sp}$ relationships. Referring to FIG. 1, it is apparent that the upper and lower boundaries of Curve A were established at 75° C. to be pAg values of 7.5 and 6.0, respectively. Similarly, the upper and lower boundaries of Curve B were established at 75° C. to be pAg values of 7.0 and 6.25, respectively. The remainder of the upper and lower boundaries of Curves A and B can be determined from a knowledge of equivalence points at other temperatures in the 30° to 90° C. range.

While maintaining the host emulsion with the silver bromoiodide laiminae deposited on the host tabular grains within the the pAg boundaries identified above, bromide silver salt is precipitated onto the major faces of the tabular grains employing any convenient conventional silver bromide or bromoiodide precipitation technique. For example, silver and bromide soluble salts, typically silver nitrate and an ammonium or alkali metal bromide, are concurrently introduced through separate silver and bromide jets. Any optional minor amount of iodide salt can be conveniently introduced as a soluble ammonium or alkali metal iodide soluble salt or as a silver iodide Lippmann emulsion through a third jet.

Deposition onto the silver bromoiodide laminae is preferably continued until the surface level of iodide ions has been significantly reduced below that exhibited after formation of the silver bromoiodide laminae. To accomplish this silver introduced during deposition onto the silver bromoiodide laminae constitutes from about 10 to 40 mole percent of total silver forming the product silver bromoiodide emulsion. Optimally from 25 to 35 mole percent of total silver is deposited onto the silver bromoiodide laminae.

In forming the emulsions of this invention as described above manipulation of the soluble silver ion concentration in the emulsion during or prior to deposition onto the silver bromoiodide laminae and during or prior to formation of the silver bromoiodide laminae can be accomplished by any convenient conventional technique. The pAg of the emulsion can be reduced at any stage of preparation by simply adding soluble silver salt (e.g., silver nitrate). The silver ion concentration of the emulsion can be increased without silver ion addition by well known techniques, such as ultrafiltration, as taught by Mignot U.S. Pat. No. 4,334,012 and *Research Disclosure*, Vol. 102, October 1972, Item 10208, and Vol. 131, March 1975, Item 13122 or coagulation washing, as taught by Yutzy and Russell U.S. Pat. No. 2,614,929.

Other than the tabular silver bromoiodide grains themselves, the only other required feature of the emulsions is the dispersing medium in which the tabular grains are formed. Any conventional dispersing medium can be employed during preparation of the tabular grain silver bromoiodide emulsions of this invention. Since a peptizer must be present to hold the tabular host grains in suspension as the tabular host grains are grown, it is common practice to include at least a small amount of peptizer in the reaction vessel from the outset of precipitation. Low methionine gelatin (less than 30 micromoles methionine per gram of gelatin) as taught by R-10 (Maskasky) constitutes a specifically preferred peptizer. The peptizer present during emulsion preparation described can range up to 30 percent by weight, preferably 0.5 to 20 percent by weight, of the total contents of the reaction vessel.

Once the emulsion has been formed, any conventional vehicle (typically a hydrophilic colloid) or vehicle extender (typically a latex) can be introduced to complete the emulsion binder employed in coating. It is taught by Dappen et al, U.S. Ser. Nos. 241,665 and 241,666, both filed Sept. 8, 1988, and commonly assigned, that the inclusion in the emulsion vehicle of methacrylate and acrylate polymer latices having glass transition temperatures of less than 50° C. and 10° C., respectively, are effective to reduce pressure desensitization of tabular grain emulsions.

Apart from the features specifically described above, the preparation and use of the emulsions of this invention follow the teachings of the art. Teachings of R-1 to R-13 inclusive are here incorporated by reference to complete disclosure of these conventional features. *Research Disclosure*, Vol. 176, December 1978, Item 17643, and Vol. 225, January 1983, Item 22534, are specifically incorporated by reference to disclose conventional photographic features compatible with the practice of this invention.

The emulsions of this invention are highly suitable for camera speed photographic applications, such as conventional black-and-white and color photography and radiography.

EXAMPLES

The invention can be better appreciated by reference to the following examples and comparisons:

Significant variations in emulsion parameters and their performance are summarized in Table I, discussed below. Apart from the identified differences in parameters listed in Table I, the emulsions were prepared similarly. Therefore, detailed emulsion preparations are provided for only representative samples of the total number of emulsions listed in Table I. Tabular grains in all of the host and product emulsions accounted for greater than 90 percent of the total grain projected areas. All of the emulsions were similarly chemically and spectrally sensitized, as described below. The emulsions were identically coated, subjected to pressure, exposed, and processed, as described below.

Representative Emulsion Precipitations

C-1 (Control)

To a reaction vessel containing 3 liters of distilled water were added 4 moles of pure silver bromide tabular grain host emulsion having the tabular grain characteristics set out in Table I. The reaction vessel was then heated to 70° C. and the pAg of the emulsion was adjusted with KBr solution to a value of 8.95. A 2 molar solution containing 340g $AgNO_3$ in water (1 liter total volume) and a 2 molar solution of a 25 mole percent iodide salt solution, based on total halide, containing 156g NaBr plus 83g KI in water (1 liter total volume) were simultaneously run into the reaction vessel each at a constant flow rate of 40 ml/min under controlled pAg (8.95) conditions.

This double run was continued for 25 minutes until the silver nitrate and halide salt solutions had been completely added. At this point a 2 molar solution of 340g silver nitrate in water (1 liter total volume) and a 2 molar solution halide salt solution of 160g sodium bromide in water (770 ml total volume) were simultaneously run into the reaction vessel each at a constant flow rate of 40 ml/min under under controlled pAg (8.95) conditions until the halide salt solution was depleted. At this point the silver addition was continued until the pAg had decreased to 8.0, depleting the silver nitrate solution. Phthalated gelatin was then added to the reaction vessel and the emulsion was washed twice by the procedure described in Yutzy and Russell U.S. Pat. No. 2,641,929. The resulting coagulated emulsion was then redispersed into a bone gelatin solution at a pH of 6.0 and a pAg of 8.3.

C-2 (Control)

To a reaction vessel containing 3 liters of distilled water were added 4 moles of pure silver bromide tabular grain host emulsion having the tabular grain characteristics set out in Table I. The reaction vessel was then heated to 70° C. and the pAg of the emulsion was adjusted with KBr solution to a value of 8.95. A 2 molar solution containing 170g $AgNO_3$ in water (0.5 liter total volume) and a 2 molar solution of a 25 mole percent iodide salt solution, based on total halide, containing 78g NaBr plus 41.5 g KI in water (0.5 liter total volume) were simultaneously run into the reaction vessel each at a constant flow rate of 40 ml/min under controlled pAg (8.95) conditions.

This double run was continued for 12.5 minutes until the silver nitrate and halide salt solutions had been completely added. At this point a 2 molar solution of 170g silver nitrate in water (0.5 liter total volume) and a 2 molar solution halide salt solution of 80g sodium bromide in water (385 ml total volume) were simultaneously run into the reaction vessel each at a constant flow rate of 40 ml/min under under controlled pAg (8.95) conditions until the halide salt solution was depleted. At this point the silver addition was continued until the pAg had decreased to 8.0. At this point the silver addition jet was closed, and the reaction vessel was cooled to 40° C. Phthalated gelatin was then added to the reaction vessel and the emulsion was washed twice by the procedure described in Yutzy and Russell U.S. Pat. No. 2,641,929. The resulting coagulated emulsion was then redispersed into a bone gelatin solution at a pH of 6.0 and a pAg of 8.3.

E-5 (Example)

To a reaction vessel containing 3 liters of distilled water were added 4 moles of pure silver bromide tabular grain host emulsion having the tabular grain characteristics set out in Table I. The reaction vessel was then heated to 70° C. and the pAg of the emulsion was not adjusted, since the pAg was determined to be 7.36. A 2 molar solution containing 170 g $AgNO_3$ in water (0.5 liter total volume) and a 2 molar solution of a 25 mole percent iodide salt solution, based on total halide, containing 78g NaBr plus 41.5g KI in water (0.5 liter total volume) were simultaneously run into the reaction vessel each at a constant flow rate of 20 ml/min under controlled pAg (7.36) conditions.

This double run was continued for 25 minutes until the silver nitrate and halide salt solutions had been completely added. At this point a 2 molar solution of 170g silver nitrate in water (0.5 liter total volume) and a 2 molar solution halide salt solution of 103g sodium bromide in water (0.5 1 total volume) were simultaneously run into the reaction vessel each at a constant flow rate of 20 ml/min under under controlled pAg (7.36) conditions until the silver solution was depleted. At this point the halide solution addition was continued until the pAg had increased to 8.0. At this point the bromide addition jet was closed, and the reaction vessel was cooled to 40° C. Phthalated gelatin was then added to the reaction vessel and the emulsion was washed twice by the Procedure described in Yutzy and Russell U.S. Pat. No. 2.641,929. The resulting coagulated emulsion was then redispersed into a bone gelatin solution at a pH of 6.0 and a pAg of 8.3.

Emulsion Sensitization

The emulsions were each optimally sulfur and gold sensitized in the presence of sodium thiocyanate then each optimally spectrally sensitized with the same combination of the following spectral sensitizing dyes:

Dye 1 Anhydro-11-ethyl-1,1'-bis(3-sulfopropyl)-naphth[1,2-d]oxazolocarbocyanine hydroxide, sodium salt and Dye 2 Anydro-5-chloro-9-ethyl-5'-phenyl-3'-sulfobutyl)-3-(3-sulfopropyl)oxacarbocyanine hydroxide, sodium salt.

Coating

The emulsions were blended with a magenta coupler and coated on a photographic film support at a silver coverage of 15 mg/dm$^2$.

Pressure Application

Pressure was applied to one sample of each coated emulsion and not to another for purposes of comparison. Pressure was applied within about 30 seconds before exposure using a diamond stylus on the back of the film. The applied pressure gave results similar to applying 25 psi by drawing the film between spaced rollers.

Exposure

The coated emulsion samples, with and without being first subjected to pressure, were exposed to daylight at a color temperature of 5500° K. for 0.01 second through a Daylight V TM and Wratten 9 TM filters using a 21 step, 0.2 log E wedge.

Processing

The exposed samples were developed for 2 minutes 30 seconds using the Kodak Flexicolor C-41 TM process (described in *British Journal of Photography Annual*, 1977, pp. 201-206).

TABLE I

| | |
|---|---|
| Em | Emulsion, prefixes C and E indicate Control and Example, respectively; |
| Ht | Mean thickness in μm of the host tabular grains; |
| HD | Mean ECD in μm of the host tabular grains; |
| HI | Mole percent iodide, based on silver, in the host tabular grain emulsion; |
| LI | Mole percent iodide, based on silver, introduced during silver bromoiodide laminae formation; |
| LpAg | pAg of silver bromoiodide laminae formation; |
| OpAg | pAg of bromide salt of silver deposition on silver bromoiodide laminae during overrun; |
| PI | Mole percent iodide, based on silver, in product silver bromoiodide emulsion; |
| Pt | Mean thickness in μm of the product emulsion grains; |
| PD | Mean ECD in μm of the product emulsion grains; |
| H:L:O | Molar ratio of silver host:laminae:overrun; |
| RLS | Relative log speed without applied pressure; |
| GU | Grain units; |
| SL | Speed change (minus indicates loss) in log speed units created by applied pressure; |
| DL | Percent change in maximum density (minus indicates loss) created by applied pressure; |
| N/A | Measurement not available for inclusion. |

TABLE I

| Em | Ht | HD | HI | LI | LpAg | OpAg | PI | PD | Pt | H:L:O | RLS | GU | SL | DL |
|---|---|---|---|---|---|---|---|---|---|---|---|---|---|---|
| C-1 | 0.10 | 2.0 | 0 | 25 | 8.95 | 8.95 | 6.30 | 2.0 | 0.18 | 4:2:2 | 104 | −4 | −18 | −20 |
| C-2 | 0.10 | 2.0 | 0 | 25 | 8.95 | 8.95 | 4.20 | 2.1 | 0.14 | 4:1:1 | 68 | +5 | −15 | −8 |
| C-3 | 0.08 | 1.4 | 0 | 25 | 8.95 | 8.95 | 10.00 | 1.9 | 0.26 | 1:2:2 | 88 | −2 | −12 | −27 |
| C-4 | 0.08 | 1.4 | 0 | 25 | 8.95 | 8.95 | 8.30 | 1.7 | 0.22 | 2:2:2 | 86 | −5 | −15 | −38 |
| E-5 | 0.08 | 2.3 | 0 | 25 | 7.36 | 7.36 | 3.14 | 2.1 | 0.14 | 4:1:1 | 78 | −1 | −2 | 0 |
| E-6 | 0.08 | 2.3 | 0 | 25 | 7.36 | 7.36 | 3.80 | 2.1 | 0.15 | 4:1:1.5 | 82 | +3 | −2 | −1 |
| E-7 | 0.08 | 2.3 | 0 | 25 | 7.36 | 7.36 | 3.60 | 2.2 | 0.17 | 4:1:2 | 95 | 0 | −4 | 0 |
| E-8 | 0.10 | 2.0 | 0 | 25 | 7.36 | 7.36 | 4.20 | 2.1 | 0.16 | 4:1:1 | 92 | 0 | −3 | −3 |
| E-9 | 0.08 | 2.3 | 0 | 25 | 7.0 | 7.0 | 3.60 | 2.2 | 0.17 | 4:1:2 | 83 | −2 | −2 | −2 |
| E-10 | 0.08 | 2.3 | 0 | 25 | 8.8 | 7.36 | 3.60 | 2.3 | 0.16 | 4:1:1 | 93 | −1 | −3 | −2 |
| E-11 | 0.11 | 2.0 | 4 | 25 | 7.36 | 7.36 | 5.90 | 2.1 | 0.20 | 4:1:2 | 98 | +3 | −1 | −3 |
| E-12 | 0.11 | 2.0 | 4 | 20 | 7.36 | 7.36 | 5.10 | 2.1 | 0.20 | 4:1:2 | 93 | +4 | 0 | −2 |
| E-13 | 0.11 | 2.0 | 4 | 15 | 7.36 | 7.36 | 4.40 | 2.2 | 0.20 | 4:1:2 | 90 | +5 | −2 | −2 |
| E-14 | 0.11 | 2.0 | 4 | 10 | 7.36 | 7.36 | 3.70 | 2.0 | 0.20 | 4:1:2 | 86 | +4 | +1 | −1 |
| E-15 | 0.11 | 2.0 | 4 | 5 | 7.36 | 7.36 | 3.00 | 2.2 | 0.21 | 4:1:2 | 82 | +3 | −2 | +1 |
| E-16 | 0.12 | 2.3 | 4 | 25 | 7.36 | 7.36 | 5.90 | 2.6 | 0.20 | 4:1:2 | 93 | N/A | −3 | −2 |
| E-17 | 0.12 | 2.3 | 4 | 30 | 7.36 | 7.36 | 6.60 | 2.6 | 0.21 | 4:1:2 | 98 | +4 | +1 | −3 |

TABLE I-continued

| Em | Ht | HD | HI | LI | LpAg | OpAg | PI | PD | Pt | H:L:O | RLS | GU | SL | DL |
|---|---|---|---|---|---|---|---|---|---|---|---|---|---|---|
| E-18 | 0.12 | 2.3 | 4 | 35 | 7.36 | 7.36 | 7.30 | 2.5 | 0.20 | 4:1:2 | 108 | +6 | −7 | −8 |
| E-19 | 0.10 | 2.3 | 4 | 35 | 7.36 | 7.36 | 7.30 | 2.2 | 0.18 | 4:1:2 | 107 | +5 | −7 | 0 |
| E-20 | 0.10 | 2.3 | 4 | 35 | 7.36 | 7.36 | 5.20 | 2.2 | 0.17 | 4:0.5:2 | 105 | 0 | −4 | 0 |
| E-21 | 0.10 | 2.3 | 4 | 25 | 7.36 | 7.36 | 4.40 | 2.1 | 0.17 | 4:0.5:2 | 94 | −1 | −4 | 3 |
| E-22 | 0.10 | 2.3 | 4 | 25 | 7.36 | 7.36 | 3.60 | 2.1 | 0.17 | 4:0.25:2 | 78 | −2 | −1 | 3 |

Comment on Results

Control emulsions C-1 to C-4 demonstrate the preparation of silver bromoiodide emulsions containing silver bromoiodide laminae on silver bromide host tabular grains. While the speed was adequate in every instance, ranging from 68 to 104 relative speed units (a Δlog E of 0.36), pressure desensitization was objectionably large, ranging from −12 to −18 relative log speed units and maximum density losses ranging from 8 to 38 percent. All of these control emulsions were prepared using silver bromide host tabular grains, 25 mole percent iodide, and a silver bromide overrun (silver and bromide additions after ending iodide addition). All laminae and overrun precipitations were conducted at the conventional pAg of 8.95. The principal differences among emulsions C-1 to C-4 were in the silver ratios of host:laminae:overrun, ranging from 1:2:2 to 4:1:1.

Example emulsions E-5 to E-7 employed host:laminae:overrun ratios comparable to C-1 and C-2. The significant difference in emulsion preparation was in employing a precipitation pAg of only 7.36 during during the laminae and overrun portions of the precipitation as compared to 8.95 in the preparing the control emulsions. Relative log speeds were between the 104 and 68 speeds of C-1 and C-2, and granularity was between the -4 and 5 grain units of C-1 and C-2. The significant improvements were in the reduction of pressure desensitization to only 2, 2, and 4 relative log speed units for E-5, E-6, and E-7, respectively, and maximum density loss to 0, 1, and 0 percent, respectively.

Example E-8 was similar to E-5 to E-7, but with the same host tabular grain emulsion being employed for E-8 as C-2 and the same host:laminae:overrun ratio being employed. Thus, the sole significant difference in precipitation conditions was in using a pAg of 7.36 for laminae and overrun precipitation for E-8 as opposed to 8.95 for C-2. Relative log speed for E-8 was 92 as opposed to only 68 for C-2, and granularity was 5 granularity units lower for the E-8 emulsion. Thus, the speed-granularity relationship, which takes into account both speed and granularity, was much superior for emulsion E-8. Pressure desensitization was measured at only 2 relative log units as opposed to 15 for emulsion C-2. Maximum density loss for E-8 was only 3% as opposed to 8% for C-2.

Emulsion E-9 was repetition of emulsion E-7, but with the pAg of the laminae and overrun precipitations being reduced to 7.0. Compared to E-7, the speed of E-9 increased and its granularity decreased. Pressure desensitization was still only 2 relative log speed units. Maximum density loss due to pressure application was measured at only 2 percent.

E-10 was prepared to demonstrate that it is the pAg during the overrun precipitation as opposed to the pAg during laminae formation that is of primary importance in achieving the advantages of the invention. E-10 was prepared like E-5, but with the laminae precipitation being undertaken at a pAg of 8.8 and the overrun precipitation being conducted at a pAg of only 7.36. E-10 was a superior emulsion having advantages over the control C-1 to C-4 in the same ranges as example emulsions E-5 to E-9.

Example emulsions E-11 to E-15 were generally comparable to example emulsion E-7 in their host:laminae:overrun ratios, although slightly thicker, lower diameter host tabular grains were employed and 4 mole percent iodide was included in the host tabular grain emulsion. The significant difference among emulsions E-11 to E-15 was the concentration of iodide used during laminae formation. Relative log speeds declined progressively from 98 to 82 with 25 to 5 mole percent iodide introduced during laminae formation. Granularity was somewhat worse than the previous examples, as would be expected from the slightly lower average aspect ratios. However, pressure desensitization remained small for each of example emulsions E-11 to E-15 inclusive. The significance of these examples is to demonstrate that the pressure response improvements are obtainable with declining iodide content, but generally at least 5 mole percent iodide should be added during laminae formation to minimize reductions in speed.

Example emulsions E-16 to E-8 were compared to demonstrate the effect of increasing iodide during laminae formation from 25 to 35 percent. Speed increased with increasing iodide. Pressure application affected these emulsions less than the control emulsions. However, at the 35 mole percent iodide level some slight reemergence of pressure sensitivity was observed, suggesting that iodide introduction during laminae formation is preferably held to 35 mole percent or less.

Example emulsions E-19 to E-22 are provided to demonstrate the effect of decreasing the proportion of the product emulsion precipitated during silver bromoiodide laminae deposition. Example emulsion E-19 was essentially similar to example emulsion E-18 and give similar results. When the precipitation during laminae formation was reduced by 50 percent, speed was not significantly reduced, while both granularity and pressure sensitivity were both significantly reduced. Example emulsions E-21 and E-22 showed lower speeds, attributable to further iodide reductions, but exhibited improvements in granularity and low levels of pressure sensitivity.

Changes in minimum density attributable to applied pressure are not included in Table I, since there was no discernable trend. The minimum density change in the control emulsions as a function of applied pressure ranged from 0.01 (C 3) to +0.10 (C-2) density units; in the example emulsions the range was from +0.01 (E-7) to +0.12 (E-21) density units.

The Effect of Pressure on Emulsions Lacking Optimum Sensitization

In the foregoing comparisons both the control and example emulsions were substantially optimally sensitized. While in every instance the example emulsions showed higher stability to applied pressure than the control emulsions, a description of the invention would not be complete without pointing out that even larger advantages over conventional emulsions are realized when comparing emulsions that have not been substantially optimally sensitized. When example and conventional emulsions are tested without sensitization or with less than optimum sensitization (underfinished), the conventional emulsions exhibit much larger pressure desensitizations than indicated in Table I; however, the example emulsions retain their high levels of performance stability when underfinished and subjected to applied pressure. Attempts to minimize excessive pressure desensitization attributable to underfinishing conventional emulsions have often resulted in overfinishing these emulsions, with increased minimum density levels resulting. Thus, conventional emulsions offer much less preparation latitude for obtaining optimum or near optimum performance.

The following comparison provides a specific illustration of the exacerbating effect on pressure desensitization of underfinishing on conventional emulsions and the relative pressure insensitivity of the emulsions of this invention a a function of variations in finishing:

C-23 (Control)

To a reaction vessel containing 3 liters of distilled water at 40° C. sufficient bone gelatin was added to give a 0.8 percent by weight gelatin solution. Sodium bromide was then added to give a concentration of 12 grams per liter. Six liters of water containing 200 grams of phthalated gelatin were heated to 90° C. in a separate vessel. A 2 molar solution of silver nitrate was run into the reaction vessel at a constant flow rate of 3.5 ml/min. for 2 minutes. At the end of this period the 6 liters of gel at 90° C. were rapidly added to the kettle. The high stirring rate resulted in a very rapid equilibration to 65° C. and a pAg of 8.95.

The reaction vessel temperature control was readjusted to 70° C. and the reaction vessel stabilized at this temperature within a minute. After the temperature stabilized, a controlled pAg double run of 2 molar silver nitrate and a 2 molar sodium bromide was commenced at an initial flow rate of 3.5 ml/min. The flow rate was then accelerated at the rate of 4 ml/min$^2$. After 60% of the total silver had been added, the double run was stopped and sodium bromide sufficient to give a reaction vessel concentration of 20 g/l was added (pAg 9.53). A solution containing 49.8 g potassium iodide in 500 ml total volume was then added over a period of 2 minutes. A single run of 2 liters of 2 molar silver nitrate was then commenced at a rate of approximately 50% that achieved when 60% of the silver had been added. The single run was continued until a pAg of 7.95 was achieved. At this point the emulsion was cooled to 40° C. and washed as described by Yutzy and Russell U.S. Pat. No. 2,614,929.

The tabular grain silver bromoiodide emulsion exhibited an ECD of 2.4 μm and a mean tabular grain thickness of 0.12 μm.

E-24 (Example)

The procedure of C 23 was repeated until 60% of the silver was added to the reaction vessel. The double run was then stopped and followed by a short single run of 2 molar silver nitrate at a rate of 35 ml/min. until a pAg of 7.36 was achieved. At this point a solution containing 49.8 g potassium iodide in 550 ml total volume was added over a 2 minute period. A single run of 2 molar silver nitrate was then run in at a rate of 35 ml/min. for approximately 11 minutes until a pAg of 7.36 was re established in the reaction vessel. The remaining 1.6 liters of silver nitrate were then run in using a controlled pAg (7.36) double run at 35 ml/min. until all of the silver hade been added. The reaction vessel was adjusted with a very small quantity of sodium bromide to a pAg of 7.95. At this point the emulsion was cooled and washed similarly as emulsion C-23.

The tabular grain silver bromoiodide emulsion exhibited an ECD of 2.2 μm and a mean tabular grain thickness of 0.13 μm, providing a close grain size match to the control emulsion C-23.

Performance Comparisons

Performance was compared similarly as for emulsions C-1 to E-22 inclusive, except that pressure was applied with two rotating stainless steel rollers rather than a diamond stylus.

One sample of each of emulsions C-23 and E-24 was finished similarly as emulsions C-1 to E-22 while a second sample of each emulsion was underfinished by 0.3 log E (30 relative log speed units). The emulsions had essentially similar granularities at optimum sensitization and relative log speeds of 102 for C-23 and 95 for E-24. Optimum sensitization speeds dropped by 16 and 2 relative log speed units for emulsions C-23 and E-24, respectively, when pressure was applied, with percent loss of maximum density being 8% for the control and only 3% for the example emulsion. Thus, at optimum sensitization the example emulsion was again clearly superior in its pressure stability characteristics.

Comparing the underfinished emulsion samples, C-23 without applied pressure exhibited a speed of 67 relative log speed units, but exhibited a loss of speed of 26 log speed units when subjected to pressure. This was an increase in pressure desensitization of 10 relative log speed units as compared to the optimally sensitized sample of emulsion C-23. Example emulsion E-24 exhibited a loss of speed of only 2 relative log speed units when pressure was applied, which was the same as the response of the optimally sensitized sample of emulsion E-24. This demonstrated the advantageous insensitivity of the emulsions of this invention to underfinishing as a function of applied pressure. Example emulsion E-24 exhibited a 0.6% loss of maximum density as a function of applied pressure, much less than the 24% loss of maximum density exhibited by the underfinished sample of control emulsion C-23.

Both the underfinished and optimally finished control emulsion samples exhibited no increase in minimum density as a function of applied pressure while the example emulsion exhibited a nominal 0.02 increase in minimum density in each instance.

Correlation of Performance with pAg

Referring to FIG. 1, point E-9 indicates the pAg of example emulsion E-9 during laminae and overrun precipitations. Point E-10 indicates the pAg of example emulsion E-10 during laminae precipitation; however, the overrun precipitation for emulsion E-10 was at the pAg indicated by point E. Point E also indicates the pAg of both laminae and overrun precipitations of the remaining example emulsions. All of the example emulsions demonstrate the advantages of this invention and share the common feature of overrun precipitation at a pAg within the pAg and temperature boundary of Curve A.

On the other hand, all of the control emulsions were formed at higher pAg levels characteristic of the prior art and exhibited higher sensitivities to applied pressure. Point C indicates the pAg of laminae and overrun precipitations of emulsions C-1 to C-4 inclusive. Point C-23 indicates the final pAg level reached in the overrun precipitation of control emulsion C-23.

The invention has been described in detail with particular reference to preferred embodiments thereof, but it will be understood that variations and modifications can be effected within the spirit and scope of the invention.

What is claimed is:

1. A process for the preparation of a silver bromoiodide emulsion comprising providing a host emulsion comprised of a dispersing medium and silver bromide grains optionally including iodide in which greater than 50 percent of the total grain projected area is accounted for by tabular grains satisfying the relationship $$ECD/t^2 > 25$$

where

ECD is the mean effective circular diaemter in μm of the tabular grains t is the mean thickness in μm of the tabular grains and forming silver bromoiodide laminae on the major faces of the tabular grains, characterized in that (a) the silver bromoiodide laminae are formed on the major faces of the tabular grains with an iodide content higher than that of the host emulsion and at least 5 mole percent, based on silver precipitated during this step, and (b) within the pAg and temperature boundaries defined by Curve A in FIG. 1 bromide is deposited on the silver bromoiodide laminae as a silver salt with any additional iodide supplied to the emulsion during this step being limited to less than 5 mole percent, based on silver introduced during this step.

2. A process according to claim 1 further characterized in that iodide accounts for at least 10 mole percent, based on silver, of the silver bromoiodide laminae as formed in step (a).

3. A process according to claim 2 further characterized in that iodide accounts for at least 15 mole percent, based on silver, of the silver bromoiodide laminae as formed in step (a).

4. A process according to claim 1 further characterized in that iodide constitutes less than 1 mole percent of total halide introduced during step (b).

5. A process according to claim 4 further characterized in that bromide is the sole halide introduced during step (b).

6. A process according to claim 1 further characterized in that step (a) is performed within the pAg and temperature boundaries defined by Curve A in FIG. 1.

7. A process according to claim 1 further characterized in that step (b) is performed within the pAg and temperature boundaries defined by Curve B in FIG. 1.

8. A process according to claim 7 further characterized in that step (a) is performed within the pAg and temperature boundaries defined by Curve B in FIG. 1.

9. A process according to claim 1 further characterized in that the silver introduced during step (a) constitutes from 1 to 40 mole percent of the total silver forming the emulsion.

10. A process according to claim 9 further characterized in that the silver introduced during step (a) constitutes from 5 to 25 mole percent of the total silver forming the emulsion.

11. A process according to claim 1 further characterized in that the silver introduced during step (b) constitutes from 10 to 40 mole percent of the total silver forming the emulsion.

12. A process according to claim 11 further characterized in that the silver introduced during step (b) constitutes from 25 to 35 mole percent of the total silver forming the emulsion.

13. A process according to claim 1 further characterized in that the host emulsion contains less than about 5 mole percent iodide.

14. A process according to claim 13 further characterized in that the host emulsion contains less than about 2 mole percent iodide.

15. A process according to claim 14 further characterized in that the host emulsion is a silver bromide emulsion.

16. A radiation sensitive silver bromoiodide emulsion prepared by the process of any one of claims 1 to 15 inclusive.

* * * * *